US008182136B2

(12) United States Patent
Harrold et al.

(10) Patent No.: US 8,182,136 B2
(45) Date of Patent: May 22, 2012

(54) POUNDING STATION FOR A PAINT MIXER

(75) Inventors: Brent Thomas Harrold, Savage, MN (US); Thomas J. Midas, Oak Park Heights, MN (US)

(73) Assignee: Red Devil Equipment Company, Plymouth, MN (US)

( * ) Notice: Subject to any disclaimer, the term of this patent is extended or adjusted under 35 U.S.C. 154(b) by 784 days.

(21) Appl. No.: 12/143,147

(22) Filed: Jun. 20, 2008

(65) Prior Publication Data

US 2009/0316521 A1 Dec. 24, 2009

(51) Int. Cl.
*B01F 11/00* (2006.01)
*B01F 15/00* (2006.01)

(52) U.S. Cl. ..... 366/208; 366/605

(58) Field of Classification Search ..... 108/6, 99, 108/115–116, 146, 179; 269/901; 366/208–219, 366/605
See application file for complete search history.

(56) References Cited

U.S. PATENT DOCUMENTS 1,281,610 A * 10/1918 Lundahl ..... 416/70 R
1,509,276 A * 9/1924 Warfel ..... 366/198
1,991,951 A * 2/1935 Matchette ..... 312/248
2,521,384 A * 9/1950 Marienthal ..... 366/249
2,777,676 A * 1/1957 Carter ..... 366/129
3,118,653 A * 1/1964 Dedoes ..... 366/200
3,464,675 A * 9/1969 Fabrize ..... 366/210
3,602,569 A * 8/1971 Caputo ..... 312/314
3,822,846 A * 7/1974 Jesionowski ..... 248/210
4,553,279 A * 11/1985 Gassew et al. ..... 7/105
4,568,194 A * 2/1986 Gargioni ..... 366/213
4,896,390 A * 1/1990 Durant ..... 7/105
4,998,742 A * 3/1991 Maynard ..... 280/35
5,083,591 A * 1/1992 Edwards et al. ..... 141/9
5,116,134 A * 5/1992 Edwards et al. ..... 366/208
5,137,367 A * 8/1992 Madonia et al. ..... 366/218
5,160,198 A * 11/1992 Fillon ..... 366/198
5,190,303 A * 3/1993 Schumacher et al. ..... 280/38
5,365,722 A * 11/1994 Edwards et al. ..... 53/502
5,460,391 A * 10/1995 Gantz et al. ..... 280/30
5,493,840 A * 2/1996 Cane ..... 53/50
5,509,672 A * 4/1996 Offerson ..... 280/47.35
5,564,343 A * 10/1996 Bartholomy et al. ..... 108/13
5,584,326 A * 12/1996 Galli ..... 141/83
5,893,572 A * 4/1999 Parks ..... 280/47.18
(Continued)

FOREIGN PATENT DOCUMENTS

GB 2059255 A * 4/1981

*Primary Examiner* — Charles E Cooley
(74) *Attorney, Agent, or Firm* — Faegre Baker Daniels LLP

(57) ABSTRACT

A paint mixer support and tray apparatus providing a pounding station for reclosing a paint container having friction fit lid. The support allows for vertically supporting up to two paint mixers, each supported on a separate horizontal plate. The tray is movable between a horizontal operating position wherein the paint container may be placed on the tray and the lid pounded down against the container, and a vertical storage position wherein the tray is pivoted up out of the way, where it may rest against a paint mixer, retained there by magnets. In the absence of an upper paint mixer, the tray may be further pivoted to rest against the upper plate resulting in a shipping position for the tray and stand. The tray may have a pair of arms in contact with the stand to support the tray in the operating position.

8 Claims, 16 Drawing Sheets

U.S. PATENT DOCUMENTS

| | | | | |
|---|---|---|---|---|
| 5,904,420 | A * | 5/1999 | Dedoes | 366/198 |
| 6,302,032 | B1 * | 10/2001 | Ranspach | 108/12 |
| 6,457,737 | B1 * | 10/2002 | King | 280/651 |
| 6,729,754 | B1 * | 5/2004 | Midas | 366/208 |
| 6,926,436 | B2 * | 8/2005 | Midas | 366/208 |
| 7,044,632 | B2 * | 5/2006 | Midas | 366/208 |
| 7,306,363 | B2 * | 12/2007 | Manke | 366/214 |
| 7,942,571 | B2 * | 5/2011 | Midas et al. | 366/217 |
| 2004/0190370 | A1 * | 9/2004 | Midas | 366/208 |
| 2007/0209893 | A1 * | 9/2007 | Carlson | 188/379 |
| 2007/0247967 | A1 | 10/2007 | Johnson et al. | |
| 2009/0316521 | A1 * | 12/2009 | Harrold et al. | 366/215 |

* cited by examiner

POUNDING STATION FOR A PAINT MIXER

CROSS REFERENCE TO RELATED APPLICATION

This application claims the benefit of U.S. Provisional Application No. 61/014,898 filed Dec. 19, 2007, the entire contents of which are hereby incorporated by reference.

TECHNICAL FIELD

This invention relates to the field of supports for commercial paint mixers, particularly for mixing paint in one gallon containers.

BACKGROUND

In the past, paint mixers were used by retail stores selling paint to blend tinting material with a base material to achieve a desired color of paint vended in conventional one gallon paint containers. Historically such containers have been metal cylinders with a press on lid. The lid was required to be removed from the container so that the tinting material could be added, and then the lid was required to be replaced on the container, often by pounding with a rubber mallet or the like until the lid was completely seated on the container. The base material and tinting material was then blended in a paint mixer receiving the one gallon container.

Stores selling paint have, in the past, required counter space or workbench space to have a work surface to pound the lid back on the paint can after tinting and before mixing. In addition, some stores have multiple mixers, to allow faster response to customers. It was known for mixer manufacturers to offer a stand to allow vertical stacking of one gallon type mixers, to save floor space. However, the problem remained of still requiring a "pounding station" surface to reclose recluse the one gallon cylindrical paint container.

SUMMARY

The present invention overcomes the shortcomings of the prior art by providing a pounding station in combination with a paint mixer support (in one embodiment) and in combination with a vertical stacking paint mixer stand (in an alternative embodiment). In one aspect, the pounding station may be a shelf or tray extending out from the stand at a height somewhat intermediate the mixers on the stand, when there are two mixers on the stand.

In another aspect, the present invention provides for a folding tray to allow the tray to be rotated up out of the way to provide more convenient access to the lower mixer on the stand. Additionally, the tray may be moved out of the way when a roller conveyor is used in conjunction with the mixer or mixers. In this aspect, the present invention may utilize means for holding the tray in the storage position, which, in one embodiment may be at least one magnet to hold the tray in a folded-up condition, through attraction between the magnet on the tray and a front (ferromagnetic) panel on an upper mixer on the stand. When the tray is pulled away from the upper mixer, the tray comes to rest in a horizontal position when arms extending from the rear of the tray contact cross members on the sides of the stand.

In another aspect, the tray of the present invention may be rotated to a shipping position in the absence of an upper mixer, to reduce the shipping volume of the tray and stand, without requiring assembly by a purchaser. When the stand is placed into operation, the tray is rotated out of the shipping position and is ready to use.

While the container mentioned above has a one gallon capacity, it is to be understood that the present invention is not limited to use with any particular size paint container, but may advantageously be used with a variety of sizes of paint containers. In addition, although a specific type of paint mixer, i.e., a vortex mixer, is shown and referenced herein, it is to be understood that the present invention may be used with other types of paint mixers as well, for example, oscillating or shaker type mixers or gyroscopic type mixers.

DETAILED DESCRIPTION

Figure 1:
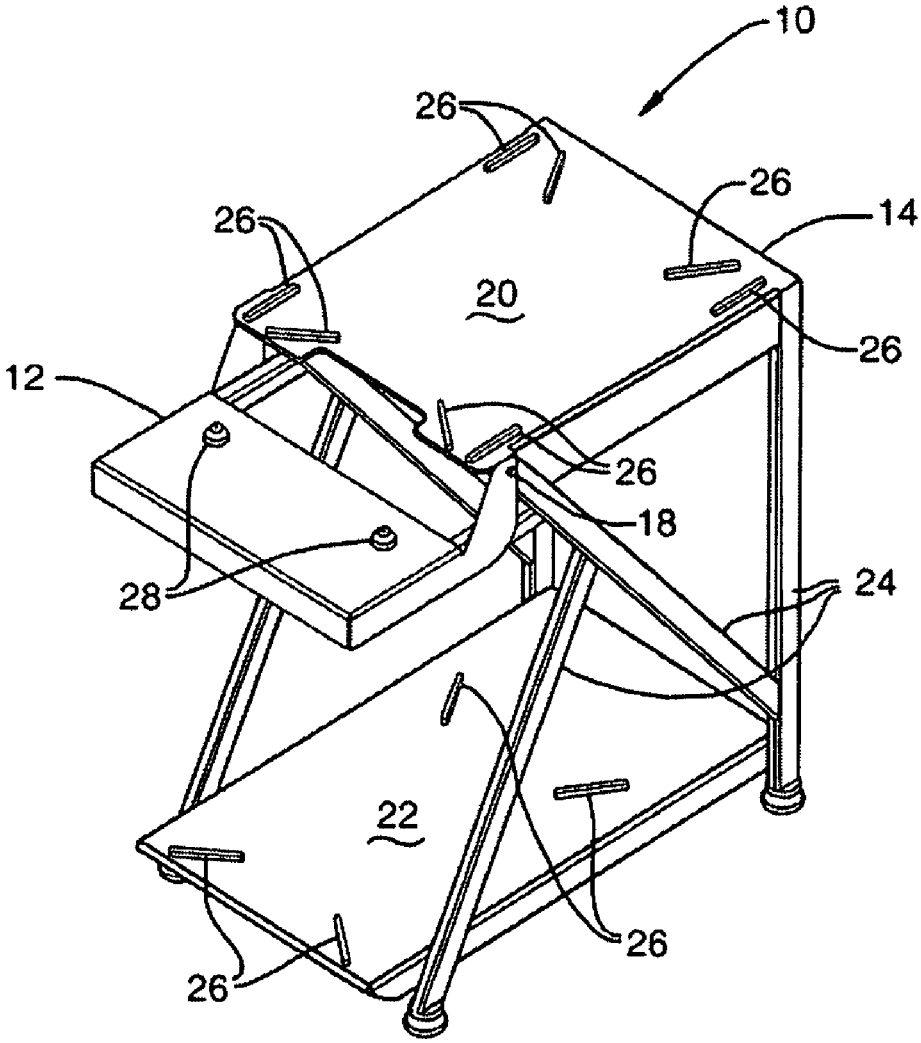
FIG. 1 shows a perspective view from the front and above of a vertical stacking paint mixer stand and tray apparatus useful in the practice of the present invention, with the tray in an operating position.
Figure 2:
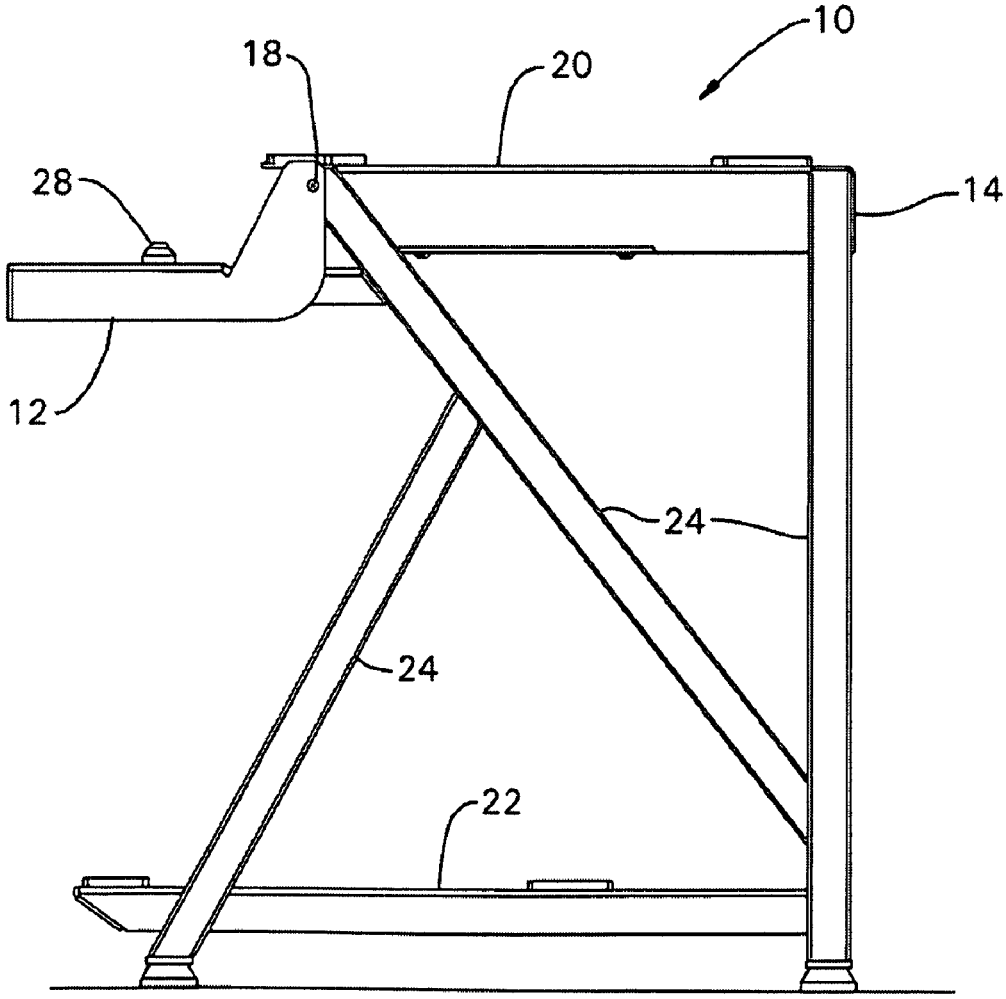
FIG. 2 is a side elevation view of the apparatus in FIG. 1.
Figure 3:
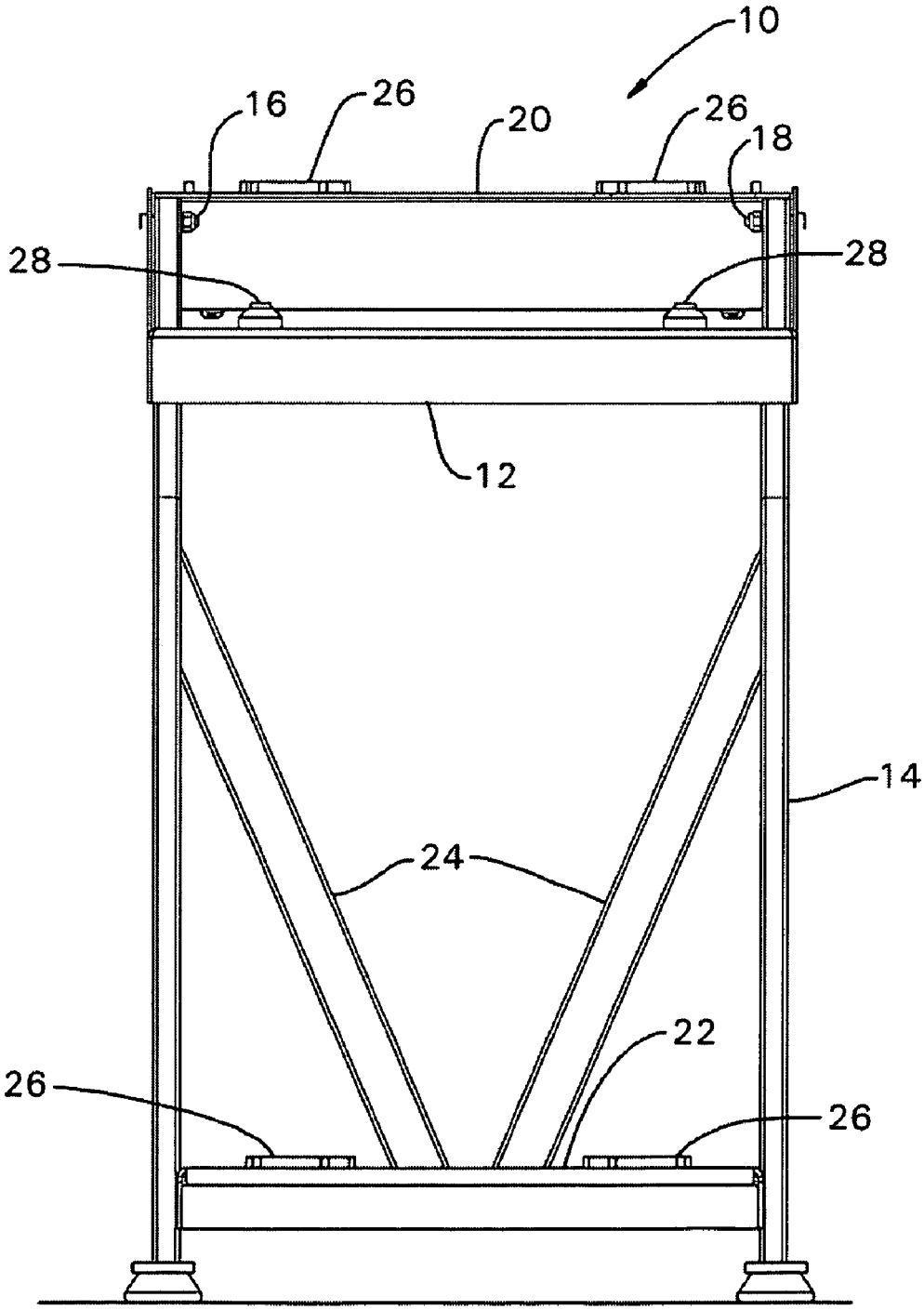
FIG. 3 is a front elevation view of the apparatus of FIG. 1.

Referring now to the Figures, and most particularly to FIGS. 1-3, a vertical stacking paint mixer stand and tray apparatus 10 useful in the practice of the present invention may be seen with a tray 12 in an operating position.

Apparatus 10 includes a stand 14 to which the tray 12 is preferably pivotably mounted at pivots 16 and 18. Stand 14 is preferably formed of sheet metal plates 20 and 22 connected by rectangular braces or members 24. Each sheet 20, 22 may have raised ridges 26 forming locator pockets for mixers to be (respectively) positioned thereon, in a manner shown infra.

Ridges 26 may be formed by welded on pieces, or by raised lips formed in plates 20 and 22, or in some other conventional manner, as desired. It is to be understood that stand 14 of the present invention may be the same as that shown in published United States Patent Application US 2007/0209893 A1, or it may be a stand similar to that, but without the tuned spring and mass system. The entire contents of US 2007/0209893 A1 is expressly incorporated herein.

Figure 7:
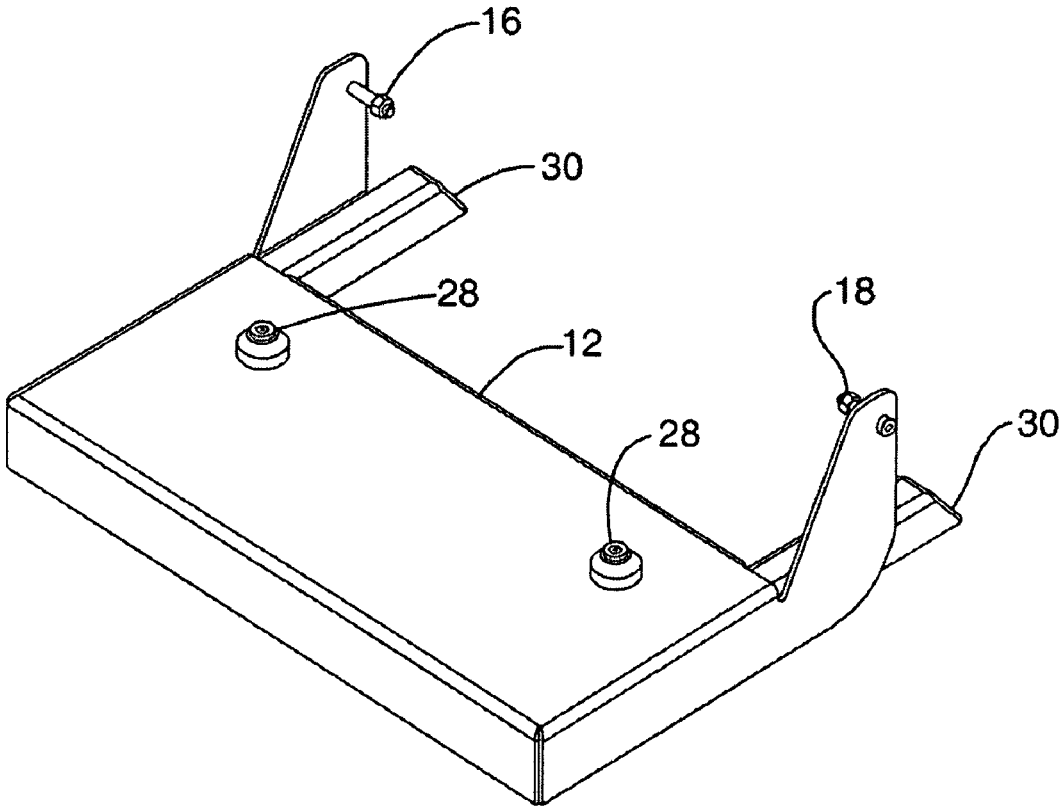
FIG. 7 is an enlarged perspective view of the tray of FIG. 1 from the front and above.
Figure 8:
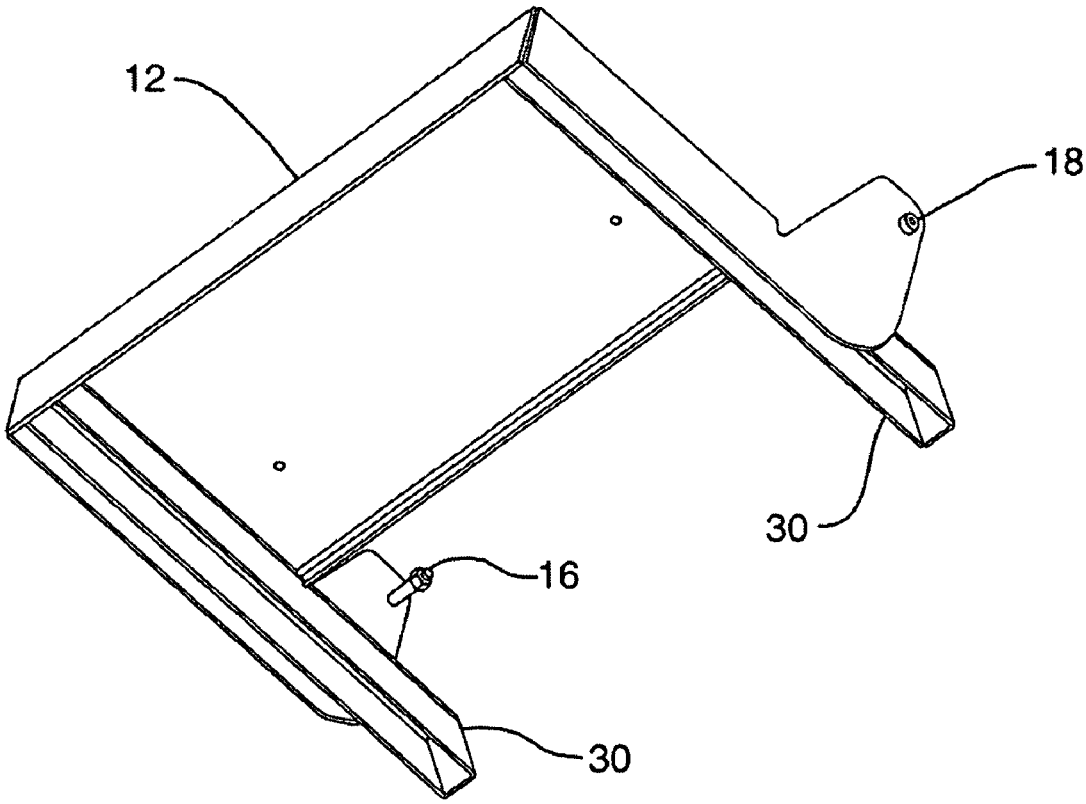
FIG. 8 is a perspective view of the tray of FIG. 7 from the front and below.

Tray 12 may have one and preferably has two magnets 28 permanently secured thereto. Tray 12 also has a pair of arms 30 extending toward and in contact with the stand, more particularly with braces 24, to hold the tray in the horizontal operating position. Enlarged views of the tray may be seen in FIGS. 7 and 8.

Figure 4:
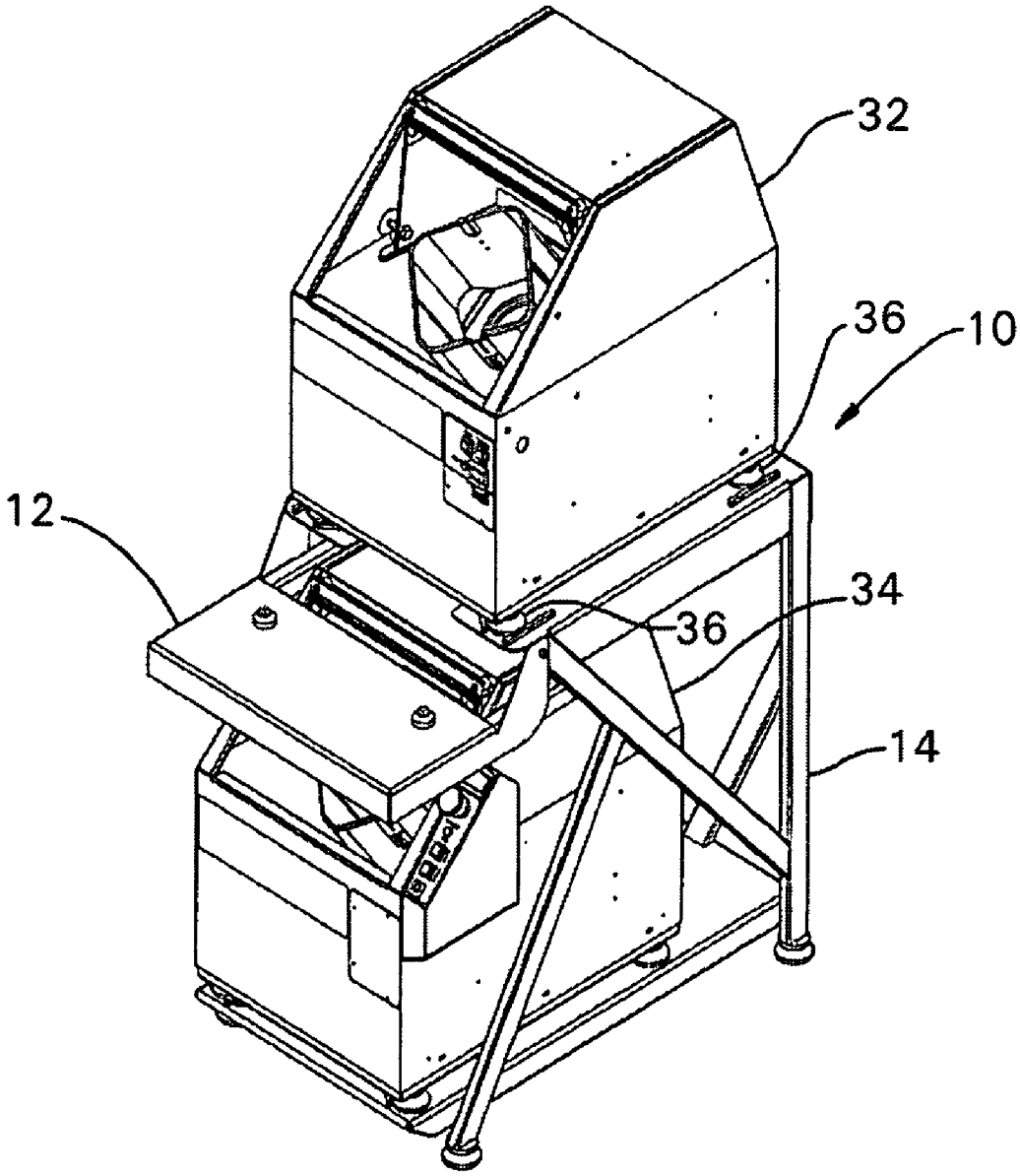
FIG. 4 shows a perspective view similar to that of FIG. 1, except with a pair of paint mixers resting on the stand.
Figure 5:
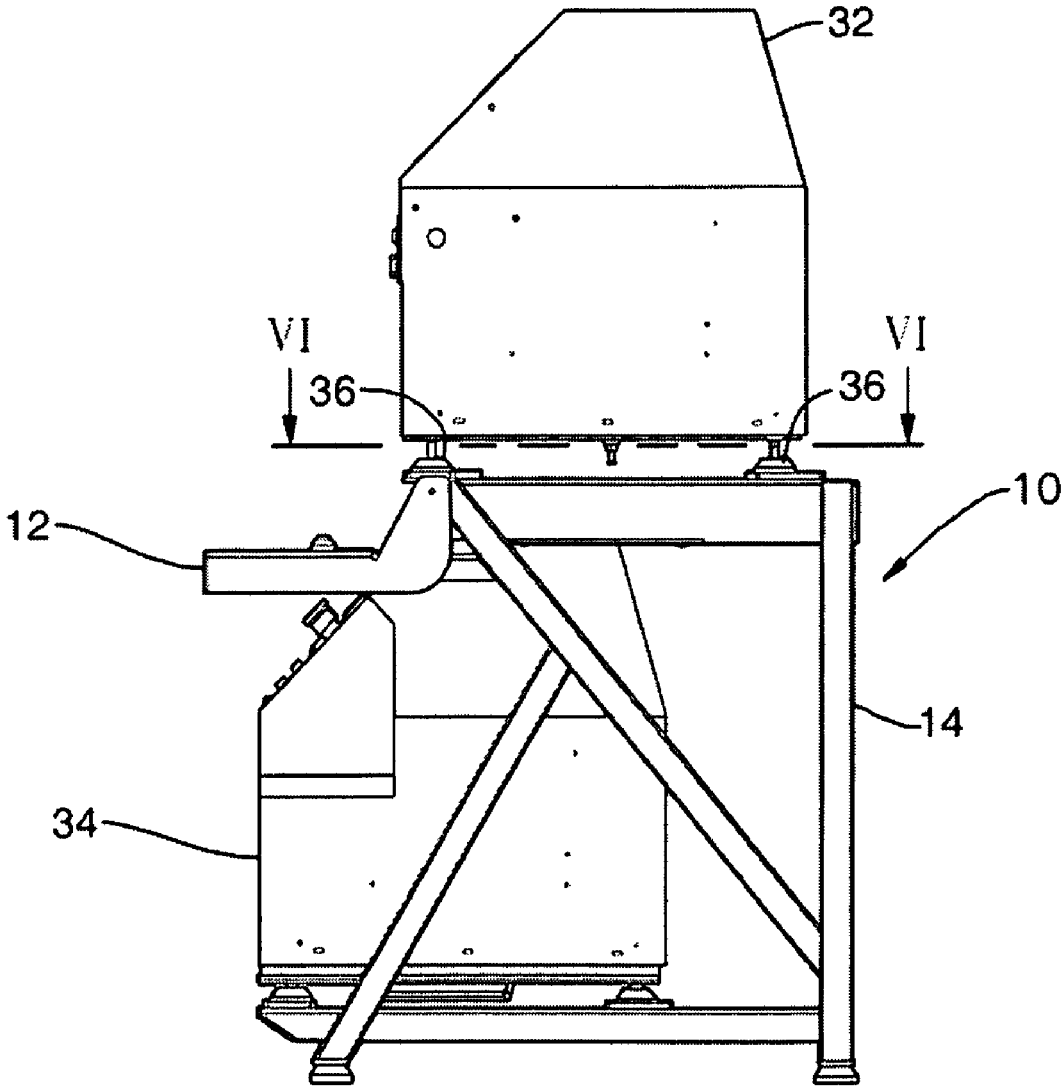
FIG. 5 is a side elevation view of the mixers and stand of FIG. 4.

Referring now to FIGS. 4 and 5, a pair of mixers 32 and 34 are shown resting on the stand 14, and in one aspect, may be considered to be part of the present invention. Upper mixer 32 and lower mixer 34 may be the same or different types. As shown mixers 32 and 34 are of the type shown in United States Patent Application US 2007/0247967 A1, or it may be a mixer similar to that, such as a model 1015 one gallon mixer available from the Red Devil Equipment Company of Plymouth, Minn. The entire contents of US 2007/0247967 A1 is expressly incorporated herein. It is to be understood that the apparatus 10 can be used as a pounding station with only one mixer, (or even no mixers) if desired. The present invention may be used with another types of mixer, as well.

Figure 6:
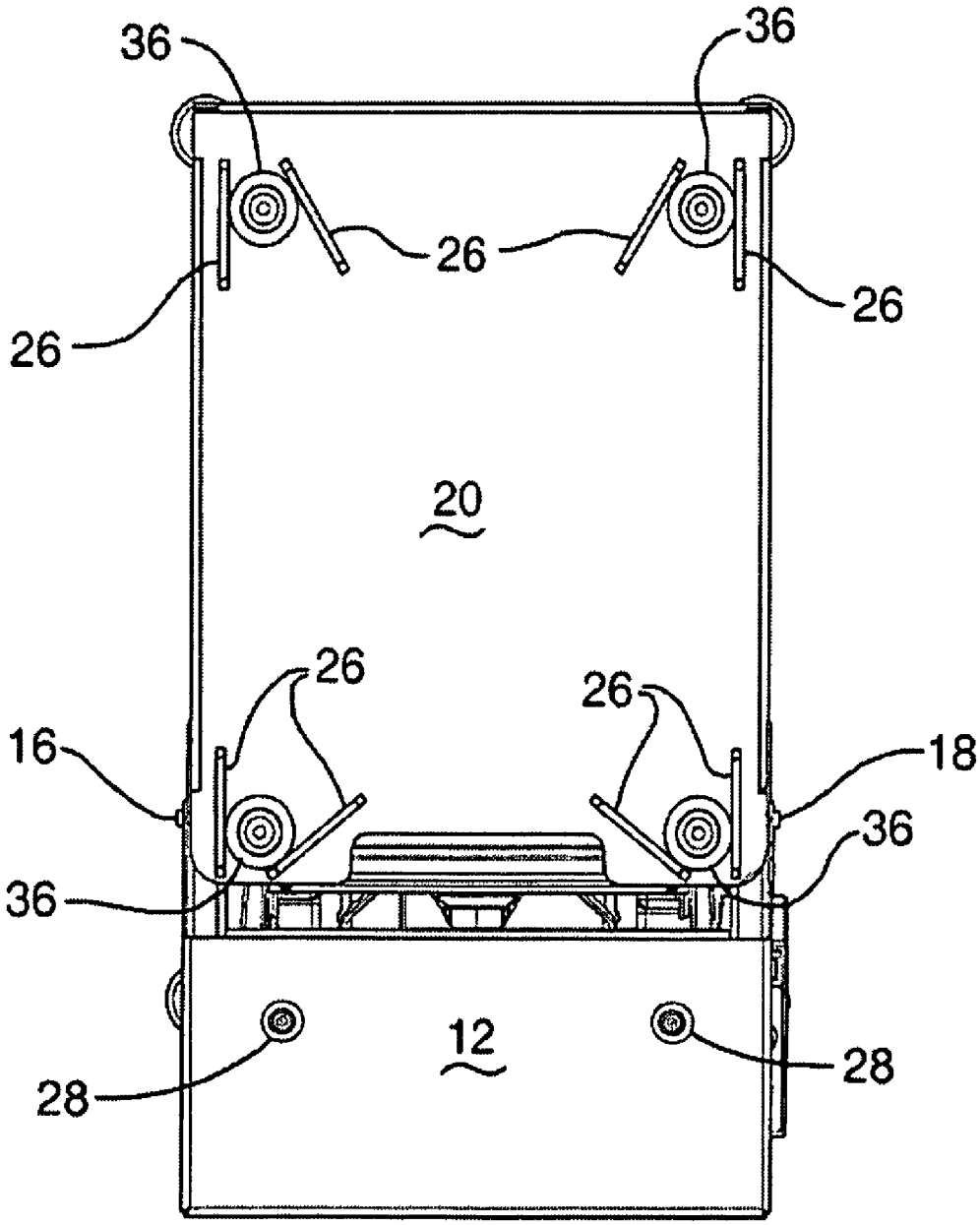
FIG. 6 is a section view along line VI-VI of FIG. 5 to illustrate the location of the feet of the upper mixer on the stand.

FIG. 6 shows a plan layout illustrating how the support feet 36 of the upper mixer 32 are preferably constrained by the raised ridges 26 to positively locate and restrain the upper mixer 32 from moving laterally with respect to the stand 14.

Figure 9:
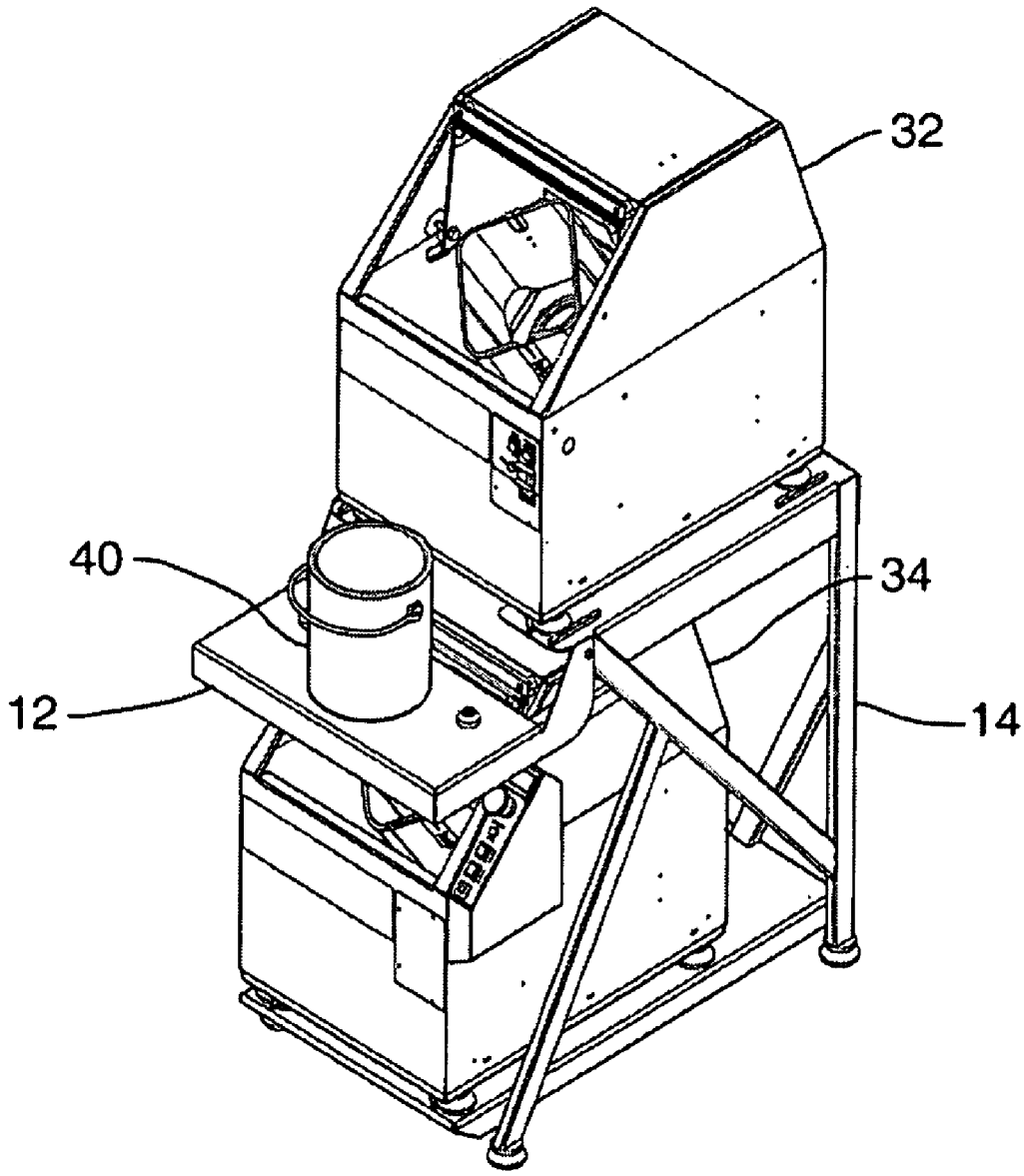
FIG. 9 is a view similar to that of FIG. 4, except with a paint container resting on the tray.
Figure 10:
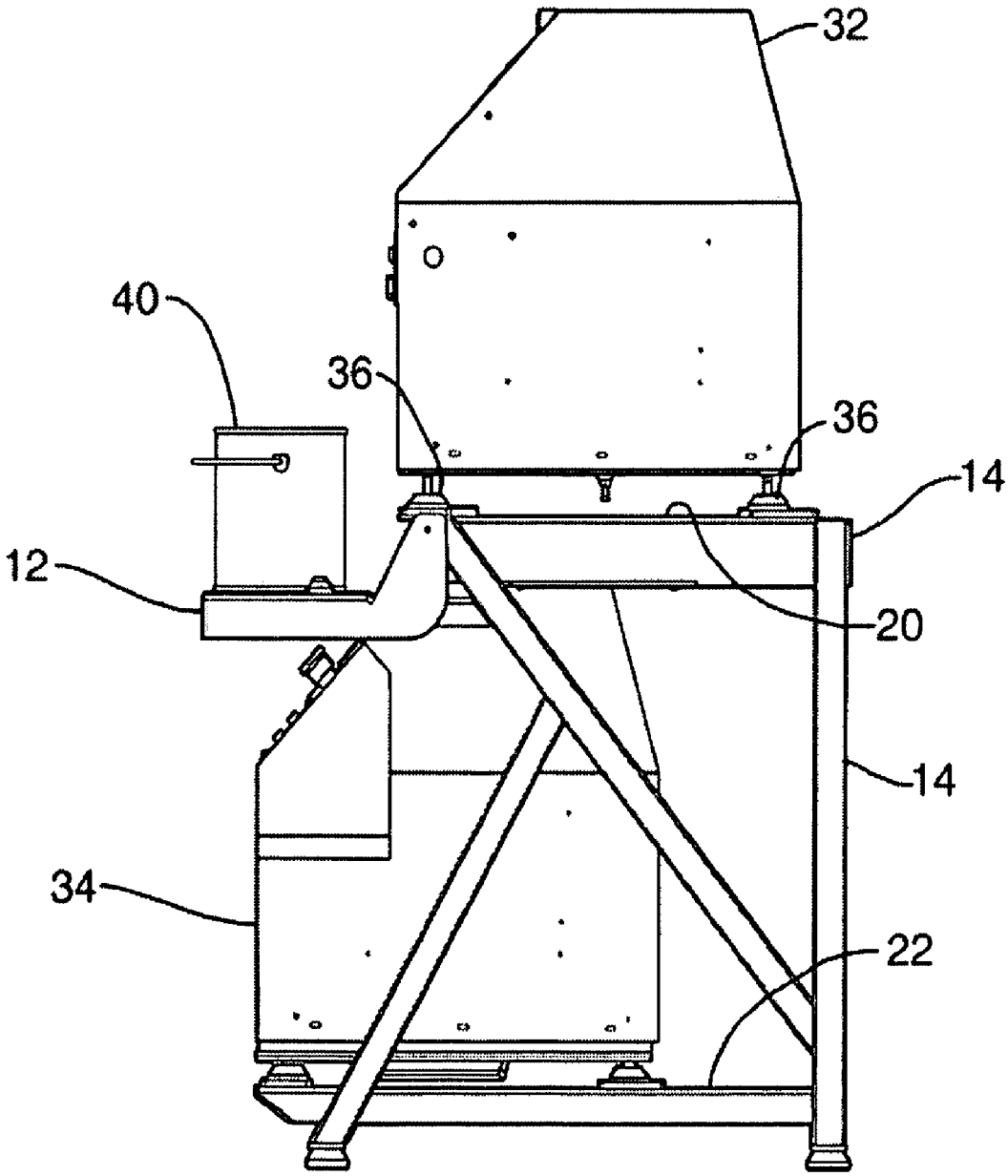
FIG. 10 is a side elevation view of the arrangement shown in FIG. 9.

Referring now most particularly to FIGS. 9 and 10, the tray 12 is shown in the operating position, with a cylindrical one gallon paint container 40 resting thereon. This is the "pounding station" of the present invention. Tray 12 provides a support for the paint can 40 to allow a user to reseal a lid on the container 40 conveniently by pounding it with a rubber mallet or the like while container 40 is resting on tray 12.

Figure 11:
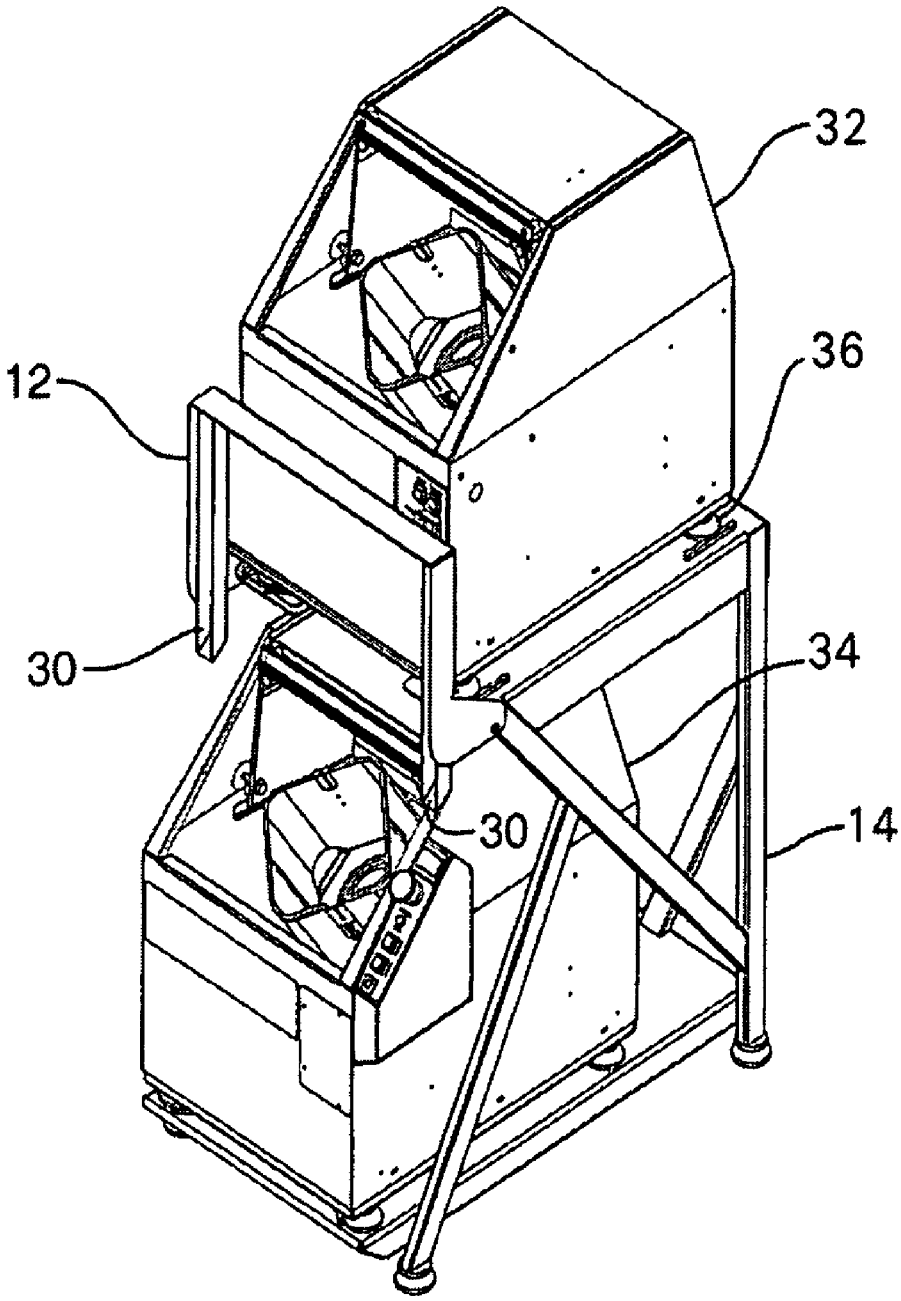
FIG. 11 is a perspective view similar to that of FIG. 4, except with the tray in a storage position.
Figure 12:
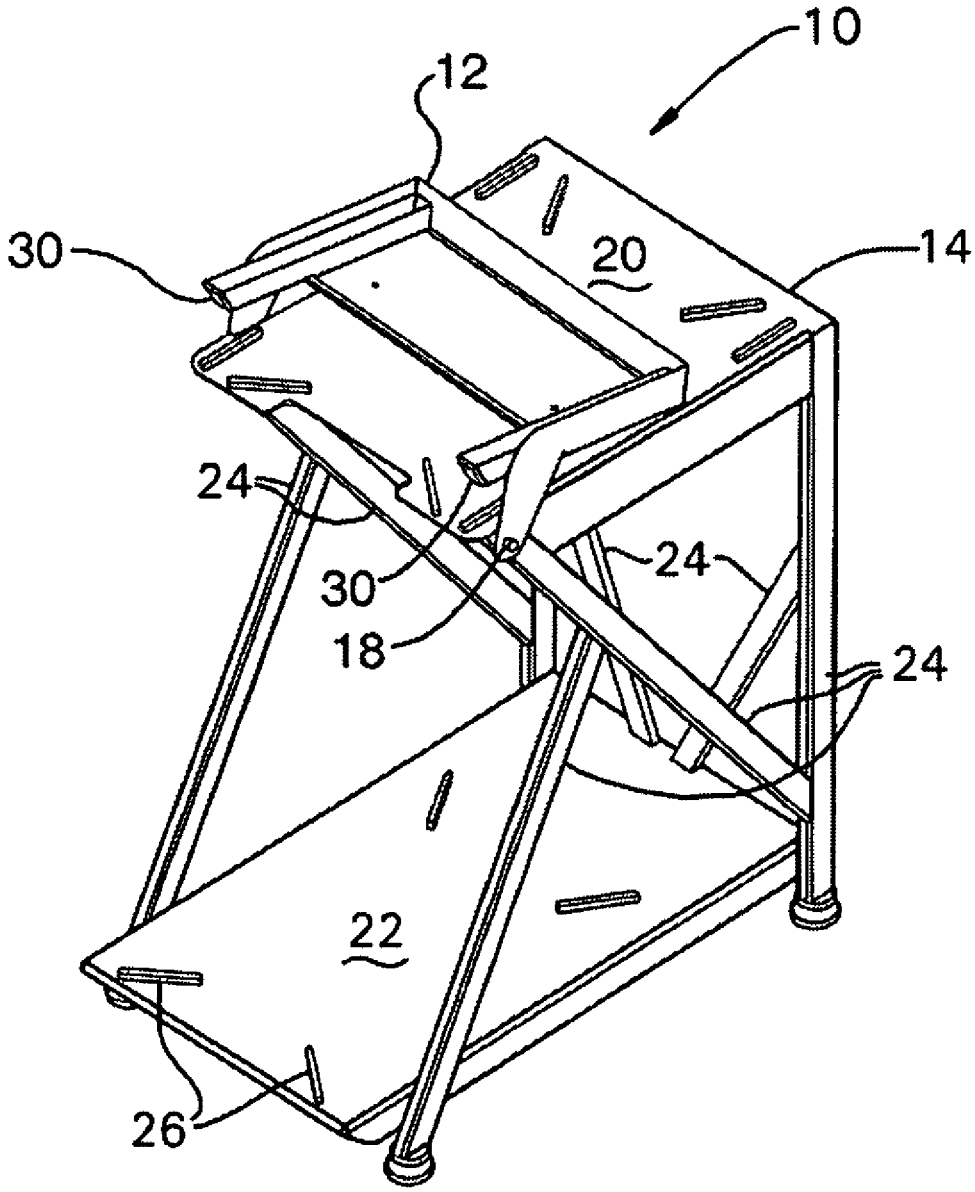
FIG. 12 is a perspective view from the front and above of the apparatus of FIG. 1, except with the tray in a shipping position.
Figure 13:
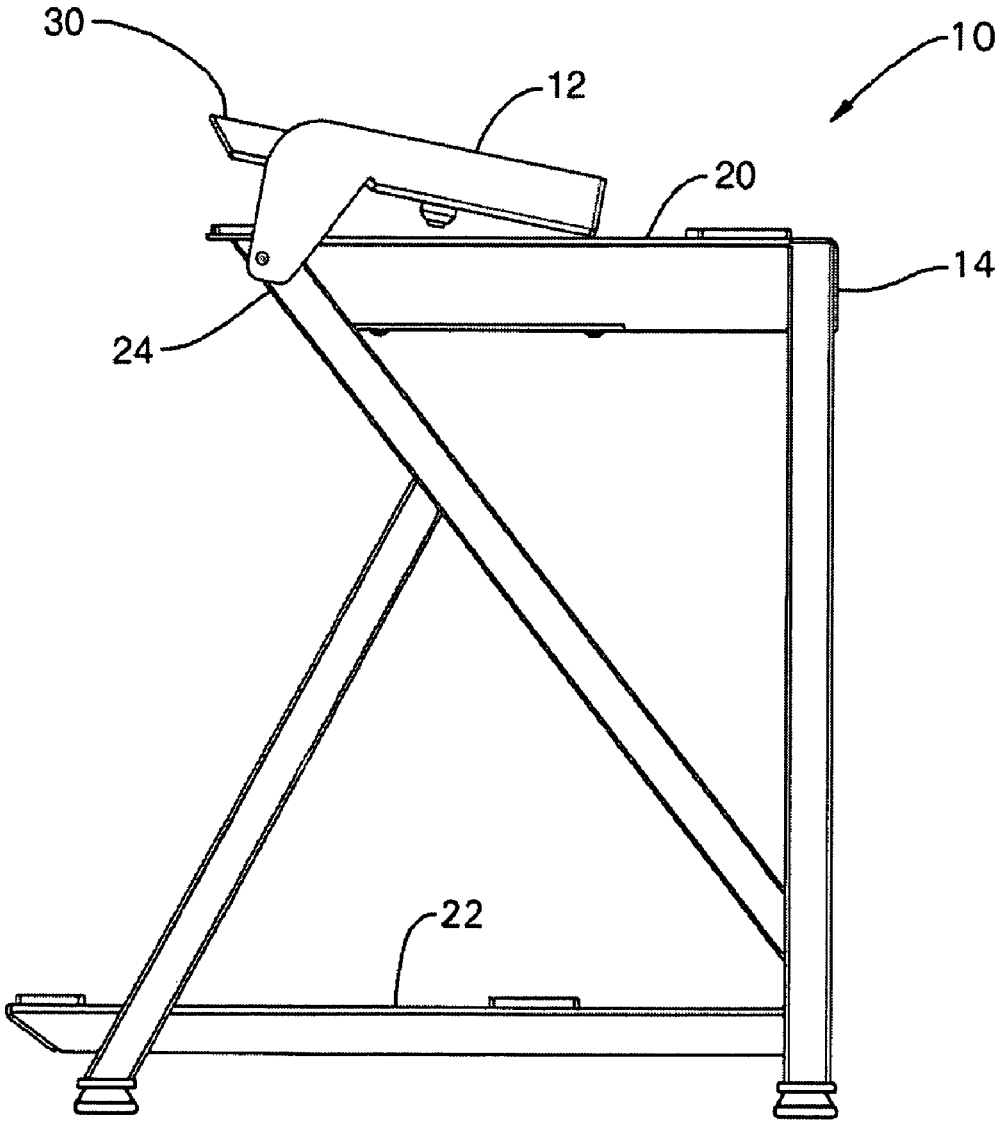
FIG. 13 is a side elevation view of the apparatus of FIG. 12.
Figure 14:
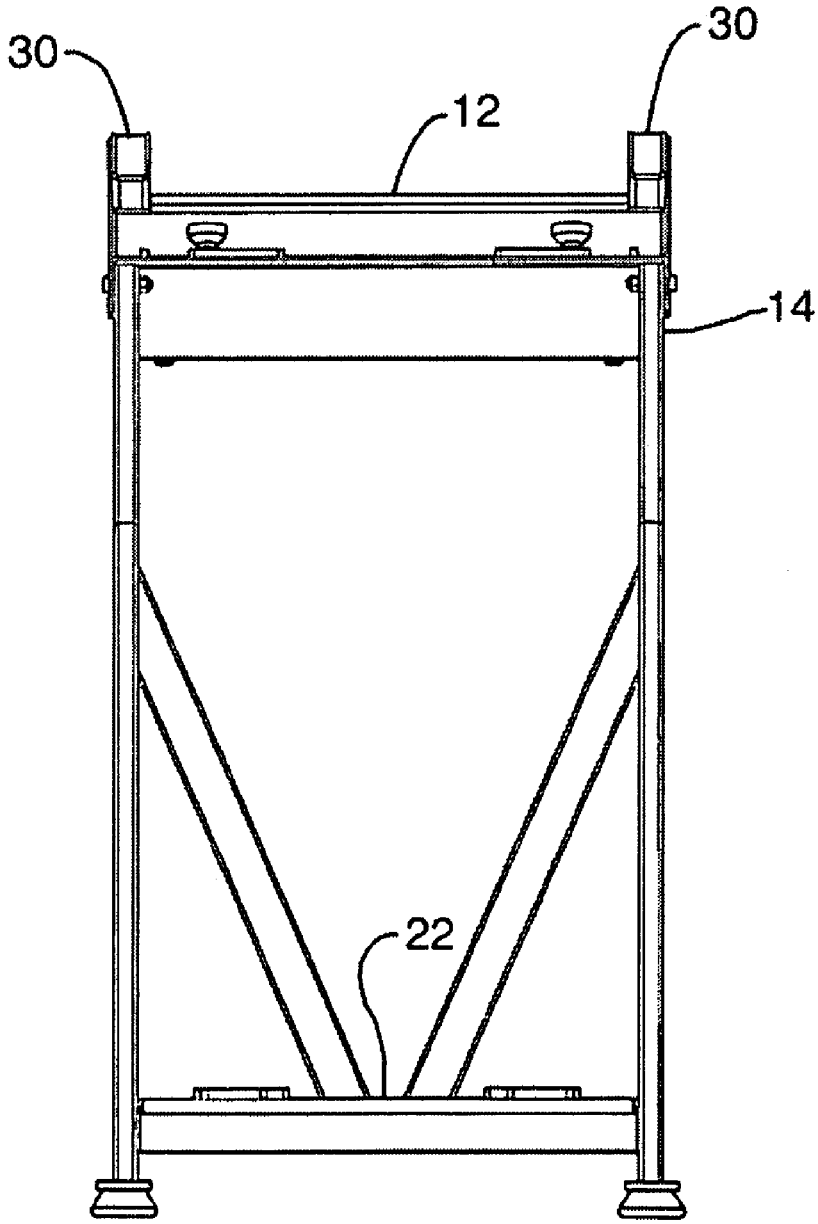
FIG. 14 is a front elevation view of the apparatus of FIG. 12.
Figure 15:
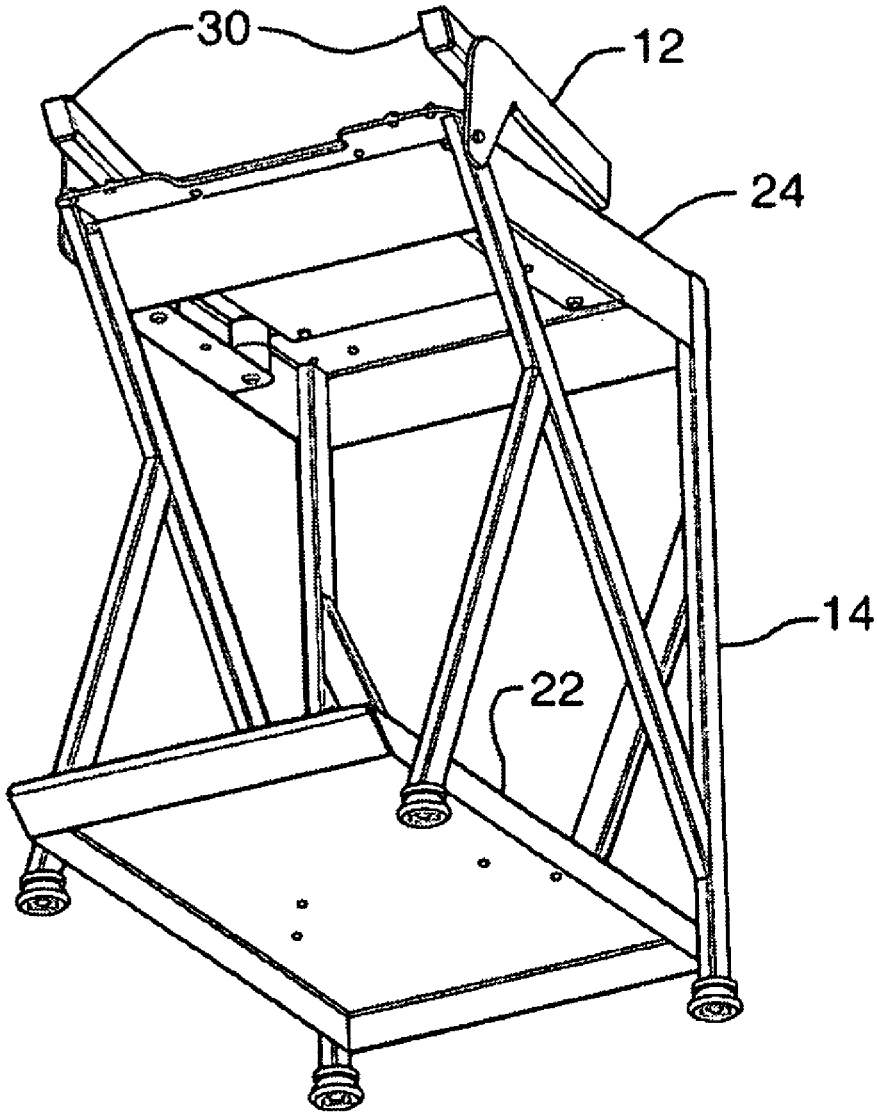
FIG. 15 is a perspective view from the front and below of the apparatus of FIG. 12.
Figure 16:
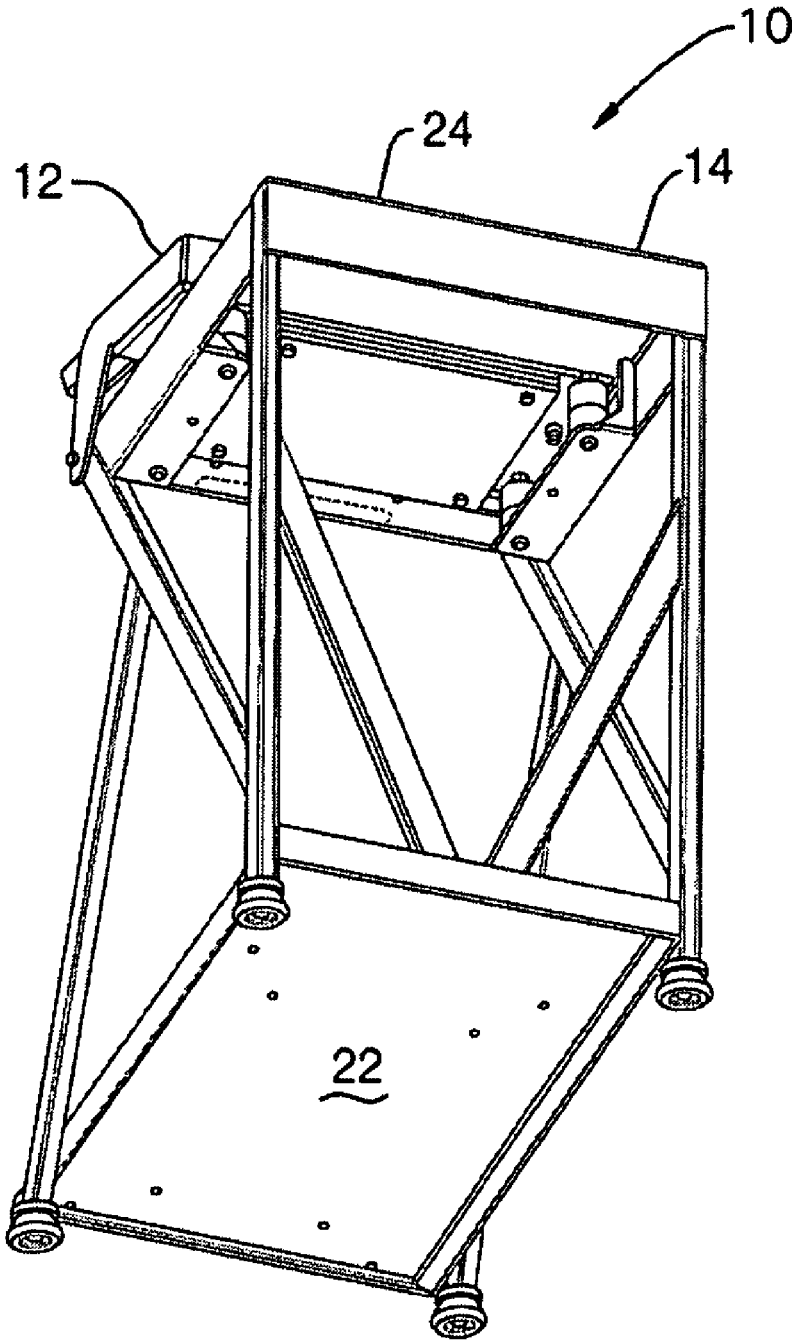
FIG. 16 is a perspective view from the rear and below of the apparatus of FIG. 12.

Referring to FIG. 11, the tray may be rotated up and out of the operating position when not needed. Once tray 12 approaches upper mixer 32, magnets 28 will retain tray 12 in the storage position shown in FIG. 11, allowing easy access to the interior of both mixers 32 and 34, and especially lower mixer 34. It is to be understood that in the practice of the present invention, tray 12 may be held in the storage position using other techniques or mechanisms, such as, but not limited to, hook and loop fasteners, one or more shock cords, one or more straps, one or more detent features or a pin and slot arrangement, with the pin on one of the tray and stand and the slot on the other of the tray and stand, with the pin captured in, but movable along the slot to retain the tray in the storage position.

Referring now to FIGS. 12-16, the tray 12 is shown in a shipping position. With the tray 12 in this position, the apparatus 10 takes up minimum volume, reducing the space needed to ship the apparatus 10, (and to store the apparatus 10 in, for example, pre-sales inventory). In the shipping position, tray 12 is rotated about pivots 16 and 18 until the tray 12 contacts the upper plate 20 of the stand 14.

In one aspect, the invention may thus be seen to be a pounding station in combination with a vertical stacking paint mixer stand. In another aspect, the present invention may be seen to be a pounding station in combination with another type of paint mixer support, such as a mixer base or riser which supports a paint mixer at a desired height.

More particularly, in the first aspect mentioned, the present invention may be seen to be an apparatus of a pounding station in combination with a vertical stacking paint mixer stand for supporting a lower paint mixer and an upper paint mixer located above the lower paint mixer on the stand, and a generally planar tray pivotably attached to the stand at or near the level of an upper planar support for the upper paint mixer and sized to receive a paint container of a size and shape to be mixed in at least one of the paint mixers, wherein the tray is positionable to an operating position wherein the tray is oriented horizontally to permit resealing a lid to the paint container on the tray, and (alternatively) to a storage position wherein the tray is oriented generally vertically against the upper paint mixer. The stand can be used with only one mixer, if desired.

In another aspect, the tray may include means for holding the tray in the storage position.

In another aspect, the invention may also include at least an upper paint mixer received on the stand.

In another aspect, the invention may also include both upper and lower paint mixers received on the stand.

In another aspect, the means for holding the tray in the storage position may include at least one magnet holding tray adjacent a ferromagnetic surface of the upper paint mixer.

In another aspect, the means for holding the tray in the storage position may include a hook and loop fastener.

In another aspect, the means for holding the tray in the storage position may include a resilient shock cord.

In another aspect, the means for holding the tray in the storage position may include a strap.

In another aspect, the means for holding the tray in the storage position may include a detent between the tray and the stand.

In another aspect, the means for holding the tray in the storage position may include a pin and slot, with the pin on one of the tray and stand, and the slot on the other of the tray and stand.

In yet another aspect, the present invention may be seen to be an apparatus of a pounding station in combination with a paint mixer support or base for supporting a paint mixer, with a generally planar tray pivotably attached to the base, with the tray sized to receive a paint container of a size and shape in which the various constituents of the paint are to be mixed, wherein the tray is positionable to an operating position wherein the tray is oriented horizontally to permit resealing a lid to the paint container on the tray, and (alternatively) to a storage position wherein the tray is oriented generally vertically.

The present invention may be found especially useful in installations having a roller conveyor in front of the mixer or mixers, with the roller conveyor positioned to assist the lateral transfer of paint containers to or from the mixer. In this arrangement, the present invention allows a user to move the tray to the operating position convenient to close the paint container, and (alternatively) to the storage position where the tray is located out of the way to avoid interference with a paint container moving along the roller conveyor.

The invention is not to be taken as limited to all of the details thereof as modifications and variations may be made without departing from the spirit or scope of the invention.

The invention claimed is:

1. An apparatus of a pounding station in combination with a paint mixer support comprising:

a support for a paint mixer having a generally horizontal supporting surface for supporting a paint mixer and a frame supporting the generally horizontal supporting surface;

a generally planar tray pivotably attached to the support, with the tray sized to receive a paint container, the tray including a pair of arms extending from a rear of the tray and configured to releasably engage the frame, the tray including pivot points positioned relative to the generally horizontal supporting surface such that the tray is movable between a shipping position in which the tray rests upside down on the generally horizontal supporting surface, a storage position in which the tray has been moved forward relative to the shipping position and the tray extends vertically upward relative to the pivot points, and an operating position in which the tray has been moved downward from the storage position into a position with the pair of arms engaging the frame to securely support the tray in a horizontal orientation to permit resealing a lid to a paint container sitting on the tray; and means for holding the tray in the storage position.

2. The apparatus of claim 1 wherein the generally horizontal supporting surface of the support for a paint mixer further comprises an upper supporting surface and the support for a paint mixer further comprises a generally horizontal lower supporting surface for supporting a lower paint mixer.

3. The apparatus of claim 2 wherein the tray is pivotably attached to the support at or near the level of the upper supporting surface.

4. The apparatus of claim 2 in combination with at least an upper paint mixer received on the support, the upper paint mixer comprising one of a vortex paint mixer, an oscillating paint mixer, a shaker paint mixer or a gyroscopic paint mixer.

5. The apparatus of claim 4 in combination with a lower paint mixer received on the support, the lower paint mixer comprising one of a vortex paint mixer, an oscillating paint mixer, a shaker paint mixer or a gyroscopic paint mixer.

6. The apparatus of claim 1 in combination with at least one vortex paint mixer received on the support.

7. The apparatus of claim 6 wherein the means for holding the tray in the storage position comprises at least one magnet on the tray adjacent a ferromagnetic surface of the at least one paint mixer.

8. The apparatus of claim 1 wherein the tray is movable to the shipping position in the absence of a paint mixer located on the generally horizontal supporting surface.

* * * * *